United States Patent [19]

Grethe et al.

[11] Patent Number: 4,698,014

[45] Date of Patent: Oct. 6, 1987

[54] METHOD AND APPARATUS FOR THE LOW-WEAR ATOMIZATION OF LIQUID HIGHLY VISCOUS AND/OR SUSPENDED FUEL INTENDED FOR COMBUSTION OR GASIFICATION IN BURNER FLAMES

[75] Inventors: Klaus Grethe, Gummersbach; Heinrich Eickhoff, Rösrath-Kleineichen; Elmar Goller, Troisdorf; Ralf Hülsen, Leverkusen, all of Fed. Rep. of Germany

[73] Assignees: L. & C. Steinmüller GmbH, Gummersbach; Deutsche Forschungs- und Versuchsanstalt für Luft- und Raumfahrt e.V., Cologne, both of Fed. Rep. of Germany

[21] Appl. No.: 812,184

[22] Filed: Dec. 23, 1985

[30] Foreign Application Priority Data

Mar. 5, 1985 [DE] Fed. Rep. of Germany ..... 3507675
Jul. 13, 1985 [DE] Fed. Rep. of Germany ..... 3525161

[51] Int. Cl.[4] ..... F23M 3/00

[52] U.S. Cl. ..... 431/9; 431/11; 431/239; 431/354; 239/403

[58] Field of Search ..... 431/9, 11, 115, 213, 431/214, 239, 350, 351, 353, 354; 239/138, 403; 432/222; 60/749

[56] References Cited

U.S. PATENT DOCUMENTS 3,852,022 12/1974 Medeot et al. ..... 431/115 X
4,033,714 7/1977 Longworth ..... 431/354
4,265,615 5/1981 Lohmann et al. ..... 431/353

*Primary Examiner*—Margaret A. Focarino
*Attorney, Agent, or Firm*—Becker & Becker, Inc.

[57] ABSTRACT

A method and apparatus for the combustion or gasification of highly viscous and/or suspended fuel in a burner flame. The fuel is introduced, in a nozzle, and in the form of a continuous, thin, annular layer, into a stream of atomizing medium, with the aid of which the fuel is atomized. The fuel is guided onto the inner wall of the nozzle as a continuous film at a velocity that is low with regard to wear action. The fuel is atomized at a terminal portion of the nozzle that has a knife-edge configuration. The fuel and the atomizing medium stream that flows within the annular film discharge at a minor resonant velocity.

20 Claims, 5 Drawing Figures

METHOD AND APPARATUS FOR THE LOW-WEAR ATOMIZATION OF LIQUID HIGHLY VISCOUS AND/OR SUSPENDED FUEL INTENDED FOR COMBUSTION OR GASIFICATION IN BURNER FLAMES

BACKGROUND OF THE INVENTION

1. Field of the Invention

The present invention relates to a method and apparatus for the combustion or gasification of highly viscous and/or suspended fuel in a burner flame. The fuel is introduced, in a nozzle, and in the form of a continuous, thin, annular layer, into a stream of atomizing medium, with the aid of which the fuel is atomized.

2. Description of the Prior Art

One method of this general type is known from the "Fifth International Symposium on Coal Slurry Combustion and Technology", Tampa, Fla., April 1983, pages 625 et seq, especially FIG. IV on page 636. With this known way of carrying out the method, the fuel exiting in an annular layer is embraced by two similar annular atomizing airstreams, and exits an annular gap together with the airstreams, accompanied by a reduction of the thickness of the layer of the fuel. The heat shield that delimits the inner edge of this annular gap requires a special cooling. Furthermore, there exists the danger that as a result of instabilities the thin annular layer makes contact with the wall portions that delimit the annular gap, where it leads to increased wear. In addition, although the atomizing material exits the conical annular gap at a relatively slow speed, the atomizing air exits at a high, major resonant speed, so that the relatively slow speed of the atomizing material cannot be so slow that atomization occurs in the nozzle as a result of shearing forces. This known method yields a relatively poor atomization quality for the gasification or combustion, especially with regard to stabilization of the flame of low-caloric fuels. Furthermore, due to the necessary major resonant exit flow, when this known method is used for pressure gasification, a very high supply pressure of the nozzle must be provided for the atomizing medium.

An object of the present invention is to provide a method and apparatus for the combustion or gasification of liquid, highly viscous and/or suspended fuel, where a low wear of the material of the nozzle occurs, and the atomization can be effected at a relatively low supply pressure of the nozzle.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 1:
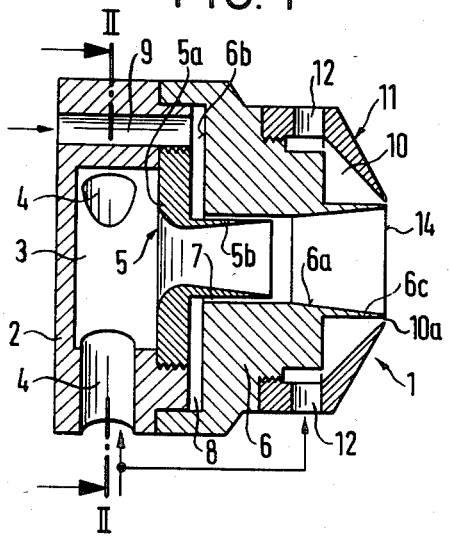
FIG. 1 is a longitudinal sectional view through a first inventive embodiment of an atomizing device.

The method of the present invention is characterized primarily in that the fuel is guided onto the inner wall of the nozzle as a continuous film at a velocity that is low with regard to wear action, with the fuel being atomized at the terminal portion of the nozzle, which has a knife-edge configuration; furthermore, the fuel, and the atomizing medium stream that flows within the annular film, discharge at a minor resonant velocity.

Since the fuel film is guided across the wall at a velocity that is low with regard to wear action, and atomization does not occur until the edge of the terminal portion with the knife-edge configuration is reached, no increased wear can occur. Since the stream of atomizing medium exits the nozzle as a stream having a complete circular cross-sectional area, no special heat shield, which could be subjected to wear, is required.

Prior to flowing by the fuel, the atomizing medium is advantageously guided through a venturi mechanism in order to impart to the atomizing medium the velocity desired for the atomization.

In order to take advantage of the supply systems for the atomizing medium present at the site of use, the inventive method can be modified such that the atomizing medium, before it passes by the film, is expanded from a high pressure to a low supply pressure that is adequate for the atomization. In this way, the atomizing medium can be taken from an existing production and/or distribution system, for example for steam, oxygen, etc., that is at high pressure, even when the pressure in the distribution system is several times greater than the pressure in the chamber where the burner flame is.

In order to further improve the stability of the flame when carrying out the inventive method, it is advantageous to swirl the atomizing medium before the latter flows by the film. In so doing, not only does the recirculation known from the aforementioned literature, page 635, FIG. 11, occur, but an internal recirculation of the flame gases all the way back into the opening of the nozzle also occurs, as a result of which the improved stabilization is achieved.

For the combustion or gasification of a highly viscous fuel, the atomizing medium is expediently heated up before it is guided by the film. By the use of steam or some other preheated atomizing medium, when the latter passes by the film the fuel is preheated to a temperature which is favorable for the atomization. In so doing, the length of the nozzle wall on which the film is provided and over which the atomizing medium passes can be designed in conformity with the required preheating.

With regard to designing the apparatus that is to be used in connection with the inventive method, it is expedient during the gasification or combustion of the fuel with air at or slightly above atmospheric pressure to utilize a portion of the pressurized combustion air as atomizing medium.

It is particularly effective for achieving a good atomizing quality over a broad load range to set the mass flow ratio between the atomizing medium and the fuel at preferably $\leqq 1$.

Further with regard to the design of the device for carrying out the inventive method, it is advantageous if, at atmospheric pressure in the burner flame, the relative velocity of the atomizing medium as it passes the fuel film has a value in the range of from 60 to 150 m/s.

At higher pressures in the burner flame, the relative velocity of the atomizing medium can be proportional to $1/\sqrt{\rho}$, where $\rho$ is the density of the atomizing medium. To further improve the atomization and especially to avoid back eddies or turbulence at the outer surface of the section having the knife-edge configuration, it is expedient to guide a further atomizing medium stream, preferably at an angle, over the edge of this section from the outside. In so doing, it is preferable to again use the same atomizing medium that flows over the fuel film.

Finally, with the inventive method, the volumes of the individual streams can be adjusted independently of one another.

The method of the present invention is of particularly advantageous use where the abrasive fuel that is to be atomized and that forms a film comprises liquid and suspended residue from mineral oil handling and refining processes, liquid and suspended residue and intermediate products from the petrochemical industry, and suspensions of coal in water or oil.

For combustion, the atomizing medium can be combustion air and/or recirculated flue gas or steam, and for gasification the gasification medium, for example, can be air, oxygen, and/or steam.

The present invention is also directed toward a burner for carrying out the method. This burner is provided with a combustion chamber and a fuel atomizing device that is disposed at the end of the combustion chamber. The atomizing device is connected to a supply of fuel, and to at least one atomizing medium line. The fuel atomizing device also has an annular gap for the discharge of the fuel, and an axially symmetrical nozzle that surrounds the annular gap.

Pursuant to the present invention, this atomizing device is characterized primarily in that the fuel supply is connected via at least one fuel supply channel with an annular channel that surrounds one end of the nozzle and communicates via the annular gap with the nozzle in such a way that the gap is delimited by the inner wall of the nozzle; the atomizing device is further characterized in that there is provided, at the other end of the nozzle, a nozzle section that forms an extension of the nozzle wall and has an annular knife-edge configuration, whereby furthermore the atomizing medium line communicates with a preliminary chamber that in turn communicates with the one end of the nozzle.

Although German Offenlegungsschrift No. 30 20 398 discloses a burner where liquid fuel, namely oil, is guided onto a section having a knife-edge configuration, this section is a flat member disposed centrally in the nozzle as a separate component, with the edge of the member being disposed in the opening of the nozzle. This known burner is neither suitable nor designed for either highly viscous or suspended fuel; this is made particularly clear by the use of an elongated sintered material member. Furthermore, here also, as described previously in connection with the starting point of the present invention, on both sides thereof the film has passing over it partial streams that exit the nozzle opening together with the film.

The inventive connection between the preliminary chamber and the nozzle is expediently effected via a venturi inlet that is concentric to the nozzle.

A particularly compact construction is achieved if the outlet section of the venturi inlet extends into one end of the nozzle, with the front end of the annular gap that is formed between this outlet section and the inner wall of the nozzle communicating with the aforementioned annular channel. The annular gap preferably has a straight cylindrical configuration. In order to achieve an expansion of the atomized stream, it is advantagously proposed that the inner wall of the outlet section of the venturi inlet, and at least the inner wall of the annular knife-edge section, be widened conically at essentially the same angle when viewed in the direction of flow. In order to achieve the advantage of improved ignition stabilization obtained as a result of swirling, the preliminary chamber is cylindrical, and the atomizing medium line communicates with the preliminary chamber via at least one tangential component. To avoid back turbulence, that end of the nozzle remote from the preliminary chamber is surrounded by an annular channel that can be supplied with a flow medium, preferably the atomizing medium. This annular channel opens toward the outside via an annular gap that surrounds the edge of the annular knife-edge section.

In order to reduce atomizing medium pressure that is greater than the pressure that is required for atomization, the atomizing medium line is designed as a stepped bore having a critical discharge crosssectional area relative to the preliminary chamber.

Finally, a particularly simple construction of the burner is achieved if the venturi inlet is mounted on a first cylindrical structural part that accommodates the preliminary chamber. The annular channel that is supplied with the fuel is disposed between one end face of this structural part and the venturi inlet on the one hand, and the facing end face of the nozzle on the other hand. Mounted on that end of the nozzle remote from this structural part is a nozzle head that together with the nozzle forms the second annular channel for the flow or atomizing medium.

DESCRIPTION OF PREFERRED EMBODIMENTS

Figure 2:
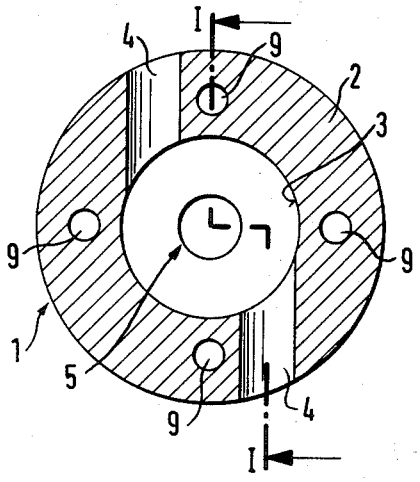
FIG. 2 is a cross sectional view through the atomizing device of FIG. 1 taken along the line II—II thereof.

Referring now to the drawing in detail, the axially symmetrical atomizing device 1 illustrated in FIG. 1 has a structural part 2 in which is provided a circular cylindrical preliminary nozzle chamber 3. The chamber 3 has an open end face, and is furthermore connected via feed lines 4 with a nonillustrated source of atomizing medium. As shown in particular in FIG. 2, the feed lines 4 are disposed tangentially relative to the preliminary nozzle chamber 3, so that the atomizing medium that enters the chamber is swirled. Threaded into the opening of the end face of the chamber 3 is a venturi inlet 5 that comprises the actual venturi section **5*a* and the discharge 5*b*. The discharge 5*b* has a conically widened inner surface and a straight-cylindrical outer wall, and extends into the passage 6*a* of a nozzle; an annular gap 7 remains between the outer wall of the discharge section 5*b*** and the nozzle.

Figure 3:
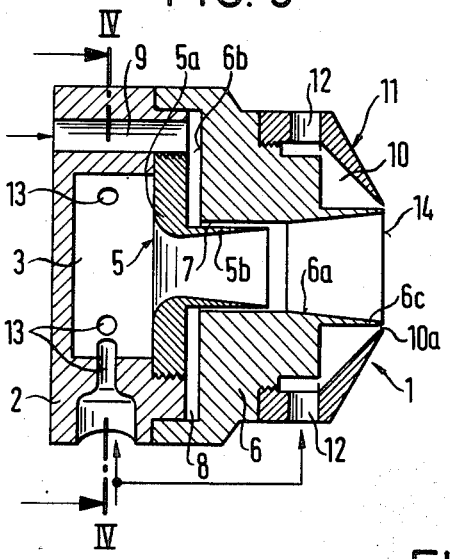
FIG. 3 is a longitudinal sectional view through a further inventive embodiment of an atomizing device.

As shown in FIGS. 1 and 3, an essentially radially extending annular channel 8 is provided between the end face of the structural part 2 and the venturi inlet 5 on the one hand and the end face **6*b* of the nozzle on the other hand. The radially inwardly disposed end of the channel 8 communicates with the annular gap 7. Fuel supply channels 9 that open into the annular channel 8 extend through the structural part 2** parallel to the axis of symmetry.

The nozzle wall ends in a knife-edge configuration **6*c*, with the nozzle wall being widened at essentially the same angle as is the discharge 5*b***.

A nozzle head 11 is threaded onto the free end face of the nozzle and is provided with an annular channel 10 which, via radially extending feed lines 12, can be supplied with an atomizing medium that can enter the atomizing stream via an annular gap 1O*a* provided between the knife-edge configuration 6*c* and the nozzle head 11 (FIG. 3). In the embodiment illustrated in FIGS. 1 and 2, not only the preliminary chamber 3 but also the channel 10 are supplied with the same atomizing medium.

Figure 4:
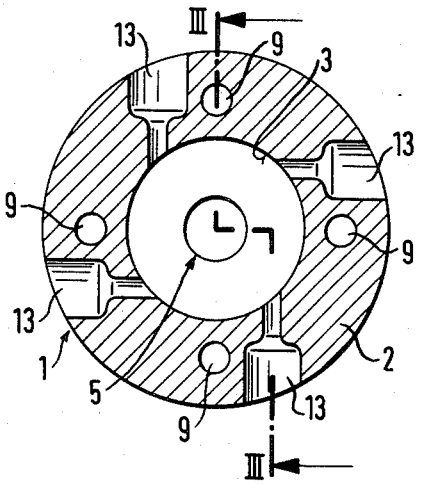
FIG. 4 is a sectional view taken along the line IV—IV in FIG. 3.

The embodiment pursuant to FIGS. 3 and 4 differs from the previously described embodiment in that in place of the straight-cylindrical feed channels 4, feed channels 13 in the shape of stepped bores are provided; these feed channels 13 are constricted in the direction toward the preliminary chamber 3, and have a critical outlet cross-sectional area relative to the preliminary chamber. Such an atomizing device can be subjected to a pressure that is higher than the pressure required for the atomizing, since a pressure reduction occurs as medium passes from the channels 13 into the preliminary chamber 3.

Figure 5:
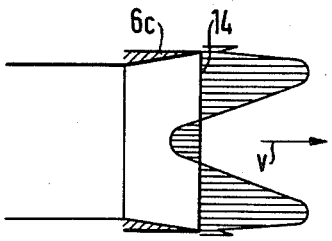
FIG. 5 is a view that plots the velocity distribution across the discharge openings of the nozzles of FIGS. 1 and 3 to illustrate the internal back flow zone.

During the operation of the atomizing device, the annular channel 8 is supplied with liquid fuel. The fuel enters the annular gap 7 and flows as a continuous film onto the inner wall of the nozzle as far as the knife-edge configuration 6*c*, where it is atomized under the influence of the atomizing medium stream that is flowing into the nozzle from the preliminary nozzle chamber via the venturi inlet. The speeds with which the two material streams exit are minor resonant speeds, i.e. undercritical speeds. As a result of the swirling of the atomizing medium stream that enters the nozzle, the velocity profile or distribution "v" shown in FIG. 5 is imparted to the atomizing medium stream in the discharge opening 14 of the nozzle. From this velocity distribution it can be seen that in the central region of the discharge opening there occurs an internal back flow that stabilizes the burner flame.

With the inventive burners, a combustion or gasification of liquid, highly viscous and/or suspended fuels can be effected with little wear of the material of the nozzle. A good stabilization of the flame is achieved just with the atomizing process of the film disposed on the inner surface of the annular knife-edge configuration. Swirling can improve this stabilization even further. With the inventive method, and the burner, a good partial load performance is achieved. Even in the case of a high pressure in the combustion chamber (combustion chamber or gasification reactor), the supply pressure of the atomizing material and the atomizing medium in the nozzle is not a function of a critical pressure ratio at the nozzle discharge.

The present invention is, of course, in no way restricted to the specific disclosure of the specification and drawing, but also encompasses any modifications within the scope of the appended claims.

What we claim is:

1. A method for the combustion or gasification of highly viscous and/or suspended fuel in a burner flame, including introducing said fuel, via an atomizing device including an inlet mechanism communicating with an atomizing medium feed line, said atomizing device being connected to a supply of fuel and also provided with an annular gap for discharge of said fuel and a nozzle having an inner nozzle wall that includes a nozzle head and that surrounds said annular gap formed between an outer wal of the inlet mechanism and said inner nozzle wall and distributing the fuel in the form of a continuous, thin, annular layer, into a stream of atomizing medium, with the aid of which said fuel is atomized; said method comprising the steps of:

providing the inner wall of said nozzle that delimits said annular gap and receives a fuel film therefrom as well as having an extension of said inner wall and said nozzle head having an annular knife-edge configuration therewith;

guiding said fuel onto said inner wall of said nozzle, as a continuous annular film, at a velocity that is low with regard to wear effected thereby;

conveying said stream of atomizing medium within and past said annular film;

atomizing said fuel at said nozzle head and extension of said nozzle wall and particularly approaching in vinicity of said annular knife-edge configuration with a subsonic velocity; and discharging said fuel, and said atomizing medium stream that flows within said annular fuel film, from said nozzle so as to depart from said annular knife-edge configuration at subsonic velocity.

2. A method according to claim 1, which includes the step of guiding said atomizing medium prior to said conveying through a venturi device in order to impart to said atomizing medium the velocity desired for atomization.

3. A method according to claim 1, which includes the step, prior to said conveying step, of expanding said atomizing medium from a high pressure to a low supply pressure that is adequate for atomization.

4. A method according to claim 1, which includes the step of swirling said atomizing medium prior to said conveying step.

5. A method according to claim 1, which includes the step of heating said atomizing medium prior to said conveying step.

6. A method according to claim 1, which includes the steps of using air that is at least at atmospheric pressure for said combustion or gasification, and utilizing a portion of said air as said atomizing medium.

7. A method according to claim 1, which includes the step of adjusting a mass flow ratio between atomizing medium and fuel of $\leqq 1$.

8. A method according to claim 1, which includes the steps of providing atmospheric pressure for said burner flame, and providing a relative velocity of said atomizing medium during said conveying step of from 60 to 150 m/s.

9. A method according to claim 1, which includes the steps of providing greater than atmospheric pressure for said burner flame, and providing a relative velocity of said atomizing medium, during said conveying step, that is proportional to $1/\sqrt{\rho}$, where $\rho$ is the density of said atomizing medium.

10. A method according to claim 1, which includes the step of conveying to said stream of discharging fuel and atomizing medium, beyond the edge of said terminal nozzle wall portion, a further stream of atomizing medium.

11. A method according to claim 1, which includes the step of adjusting the volumes of said fuel and atomizing medium independently of one another.

12. An atomizing device for use with a burner for the combustion or gasification of highly viscous and/or suspended fuel in a burner flame in a combustion chamber; the atomizing device being provided with an inlet mechanism and connected to a supply of fuel, and to at least one atomizing medium line; the atomizing device is also provided with an annular gap for the discharge of said fuel, and an axially symmetrical nozzle that surrounds said annular gap and has a first and second end; said atomizing device further comprises:

an inner nozzle wall that delimits said annular gap formed between an outer wall of the inlet mechanism and said inner nozzle wall and receives a fuel film therefrom;

an annular channel that surrounds said first end of said nozzle and communicates with said annular gap;

at least one fuel supply channel that communicates with said supply of fuel and with said annular channel;

a nozzle section that is provided at said second end of said nozzle, forms an extension of said inner nozzle wall, and has an annular knife-edge configuration; and a preliminary chamber that communicates via the inlet mechanism with said first end of said nozzle, with said atomizing medium line communicating with said preliminary chamber.

13. An atomizing device according to claim 12, which includes a venturi inlet mechanism that is concentric to said nozzle and effects said communication between said first end of the nozzle and said preliminary chamber.

14. An atomizing device according to claim 13, in which said venturi inlet mechanism has a discharge portion that extends into said first end of said nozzle, with said annular gap being formed between said discharge portion and said inner nozzle wall; that end of said annular gap remote from said second end of said nozzle communicates with said annular channel.

15. An atomizing device according to claim 14, in which said annular gap has a straight cylindrical configuration.

16. An atomizing device according to claim 14, in which the inner wall of said discharge portion of said venturi inlet mechanism, and at least the inner wall of said nozzle section that has a knife-edge configuration, are provided with conical expansions which, when viewed in the direction of flow, essentially extend at the same angle.

17. An atomizing device according to claim 12, in which said preliminary chamber is cylindrical, and in which said atomizing medium line communicates with said preliminary chamber via at least one tangential component.

18. An atomizing device according to claim 12, which includes, at said second end of said nozzle, a further annular channel that surrounds said nozzle section that has a knife-edge configuration, is connected to a supply of flow medium, and opens outwardly via a further annular gap that surrounds the edge of said last-mentioned nozzle section.

19. An atomizing device according to claim 18, in which said flow medium is said atomizing medium.

20. An atomizing device according to claim 12, in which said atomizing medium line is in the form of a stepped bore having a critical discharge cross-sectional area relative to said preliminary chamber.

* * * * *